US009301554B2

(12) United States Patent
Whaley

(10) Patent No.: US 9,301,554 B2
(45) **Date of Patent: *Apr. 5, 2016**

(54) CLOTHING SYSTEMS HAVING RESISTANCE PROPERTIES

(71) Applicant: TITIN ATHLETICS, LLC, Lake Success, NY (US)

(72) Inventor: Patrick Gerald Whaley, Cumming, GA (US)

(73) Assignee: TITIN ATHLETICS, LLC, Lake Success, NY (US)

( * ) Notice: Subject to any disclaimer, the term of this patent is extended or adjusted under 35 U.S.C. 154(b) by 125 days.

This patent is subject to a terminal disclaimer.

(21) Appl. No.: 13/940,306

(22) Filed: Jul. 12, 2013

(65) Prior Publication Data

US 2013/0305427 A1 Nov. 21, 2013

Related U.S. Application Data

(63) Continuation of application No. 13/170,008, filed on Jun. 27, 2011, which is a continuation-in-part of application No. 12/323,882, filed on Nov. 26, 2008, now Pat. No. 8,156,572, and a continuation-in-part of (Continued)

(51) Int. Cl.

| | |
|---|---|
| ***A63B 21/065*** | (2006.01) |
| ***A41D 1/00*** | (2006.01) |
| ***A63B 21/06*** | (2006.01) |
| ***A63B 23/035*** | (2006.01) |

(52) U.S. Cl.

CPC ..... *A41D 1/00* (2013.01); *A63B 21/0602* (2013.01); *A63B 21/065* (2013.01); *A63B 21/4005* (2015.10); *A63B 21/4009* (2015.10); *A63B 23/03575* (2013.01)

(58) Field of Classification Search

CPC ..... A63B 21/065; A63B 21/0602; A63B 21/0603; A63B 23/03575; A63B 23/00; A63B 21/4005; A63B 21/4009; A41D 1/00; A41D 1/08; A41D 13/0012

USPC ..... 2/69, 79, 247, 115, 102; 482/105

See application file for complete search history.

(56) References Cited

U.S. PATENT DOCUMENTS

| | | | | |
|---|---|---|---|---|
| 1,128,682 A | | 5/1915 | Homewood | |
| 1,729,209 A | * | 9/1929 | Austin | 482/105 |
| 2,075,945 A | | 4/1937 | Hurt | |

(Continued)

FOREIGN PATENT DOCUMENTS

WO 2007129853 A1 11/2007

*Primary Examiner* — Amy Vanatta

(74) *Attorney, Agent, or Firm* — Troutman Sanders LLP; Ryan A. Schneider; Benjamin C. Wiles

(57) ABSTRACT

A weighted article of clothing having cooling properties, comprising a clothing substrate with weights attached thereto, the weights being made of a gel and being strategically placed so as to not interfere with the movements of a wearer and to not interfere with outer clothing or equipment worn over the weighted article of clothing and with the weights being arranged in a plurality of weight clusters and linking strands, with neighboring weight clusters being connected together with the linking strands. An exercise and training device for swimmers in the form of a shirt, top, or singlet that, due to the material of manufacture, increases the resistance to the swimmer's movement through the water.

20 Claims, 9 Drawing Sheets

Related U.S. Application Data application No. 12/508,237, filed on Jul. 23, 2009, now Pat. No. 8,375,465.

(60) Provisional application No. 61/358,563, filed on Jun. 25, 2010, provisional application No. 60/991,008, filed on Nov. 29, 2007, provisional application No. 61/082,938, filed on Jul. 23, 2008.

(56) References Cited

U.S. PATENT DOCUMENTS 2,241,833 A * 5/1941 Waller ..... 482/105
2,710,008 A 6/1955 Jensen
D195,134 S * 4/1963 Tarbox ..... D21/683
3,142,485 A 7/1964 Jacobson
3,436,762 A 4/1969 Cahan
3,528,652 A * 9/1970 Tarbox ..... 482/105
4,179,754 A 12/1979 Denu
4,268,917 A * 5/1981 Massey ..... 2/102
4,302,007 A 11/1981 Oprean et al.
4,330,120 A * 5/1982 Netti ..... 482/105
4,343,044 A 8/1982 Borda et al.
4,407,497 A * 10/1983 Gracie ..... 482/105
4,538,615 A 9/1985 Pundyk
4,654,894 A 4/1987 Kudo
4,684,123 A * 8/1987 Fabry ..... A63B 21/065 482/105
4,853,976 A 8/1989 Mertz
4,916,755 A 4/1990 Feigenbaum et al.
4,956,878 A 9/1990 Boynton
4,989,267 A * 2/1991 Watson ..... 2/102
4,999,845 A 3/1991 Jenks, Jr. et al.
5,002,268 A 3/1991 Anderson
5,011,137 A 4/1991 Murphy
5,033,116 A 7/1991 Itagaki et al.
5,048,125 A 9/1991 Libertini et al.
1,962,984 A 1/1993 Crego
5,282,277 A 2/1994 Onozawa
5,367,708 A 11/1994 Fujimoto
5,484,366 A 1/1996 Wilkinson
5,487,710 A 1/1996 Lavorgna et al.
5,667,466 A * 9/1997 Riley, Jr. ..... 482/105
5,742,936 A 4/1998 Tronc
5,755,110 A 5/1998 Silvas
5,768,703 A 6/1998 Machado et al.
5,784,716 A * 7/1998 Holt ..... A63B 21/065 2/69
5,868,652 A 2/1999 Spletzer
5,913,408 A 6/1999 Shanahan
5,937,441 A 8/1999 Raines
5,951,446 A 9/1999 Monforte
5,978,964 A 11/1999 Gaston
6,185,742 B1 2/2001 Doherty
6,209,135 B1 4/2001 Irvin
6,484,319 B1 11/2002 Fusco et al.
6,546,560 B2 4/2003 Fusco et al.
6,554,752 B2 4/2003 Cook
6,557,176 B2 5/2003 Franco-Sion
6,665,879 B2 12/2003 VandenBerg
7,104,932 B1 9/2006 Brentlinger
D545,028 S * 6/2007 Myrick ..... D2/728
8,062,194 B2 * 11/2011 Weiss ..... 482/105
8,156,572 B2 4/2012 Whaley
8,375,465 B2 2/2013 Whaley
2002/0152531 A1 10/2002 Fusco et al.
2002/0184696 A1 12/2002 Hochmuth
2003/0092544 A1 5/2003 Reed
2004/0221355 A1 11/2004 Garcia
2005/0223476 A1 10/2005 Volk
2006/0135326 A1 6/2006 Virji et al.
2006/0150295 A1 7/2006 Paternoster
2006/0172870 A1 8/2006 Virji
2006/0276089 A1 12/2006 Amarasinghe et al.
2007/0173385 A1 * 7/2007 Cohenca et al. ..... 482/105
2008/0141430 A1 6/2008 Rance
2008/0256675 A1 10/2008 Di Lorenzo
2009/0038047 A1 2/2009 Di Lorenzo
2009/0205106 A1 8/2009 Sohn
2010/0212057 A1 8/2010 Sullivan

* cited by examiner

CLOTHING SYSTEMS HAVING RESISTANCE PROPERTIES

CROSS-REFERENCE TO RELATED APPLICATIONS

This Application is a continuation application claiming priority to U.S. patent application Ser. No. 13/170,008, filed on 27 Jun. 2011. U.S. patent application Ser. No. 13/170,008 is a continuation-in-part application claiming priority to U.S. patent application Ser. No. 12/323,882, now U.S. Pat. No. 8,156,572, filed on 26 Nov. 2008, and is also a continuation-in-part application claiming priority to U.S. patent application Ser. No. 12/508,237, now U.S. Pat. No. 8,375,465, filed on 23 Jul. 2009, and is also a non-provisional application claiming priority to U.S. Provisional patent application Ser. No. 61/358,563, filed on 25 Jun. 2010. U.S. patent application Ser. No. 12/323,882 is a non-provisional application claiming priority to U.S. Provisional Application No. 60/991,008, filed on 29 Nov. 2007. Additionally, U.S. patent application Ser. No. 12/508,237 is a non-provisional application claiming priority to U.S. Provisional Application 61/082,938, filed on 23 Jul. 2008. All applications are herein incorporated by reference as if fully set forth below.

BACKGROUND OF THE INVENTION

1. Field of the Invention

The present invention generally relates to clothing systems, including weighted clothing for wearing during an exercise regimen. This invention also has cooling properties which may be used during either exercise or for comfort purposes. The present invention also relates to drag inducing clothing for wearing during an exercise regimen.

2. Description of the Related Art

In order to enhance the effects of a workout, some people, especially athletes, carry additional weights when exercising. For example, wrist and ankle weights are available for wearing bracelet-like and anklet-like to increase the strength and stamina of the arms and legs by requiring a user to exert extra effort when moving the arms or legs during running or other motion exercises. Members of the armed forces often wear weighted backpacks or backpacks containing weights when walking or hiking for increasing the strength and stamina of the legs and torso. Carrying such extra weight can increase the effort of the muscles, thus increasing the strength and stamina of the muscles upon continued use of the extra weights. Weighted clothing also exists for the same purpose. Wrist, ankle, backpack, and clothing weights, however, also have the potential of causing joint strain and damage.

U.S. Pat. No. 5,978,964 is a sportswear garment manufactured from a form-fitting clothing article having at least one flexible weight and a plurality of pockets to receive and maintain the weights in an immobile manner. U.S. Pat. No. 5,937,441 is a weighted suit to be used in athletic training, physical therapy, muscle toning and weight reduction. U.S. Pat. No. 5,048,125 is an article of apparel for use as athletic sportswear comprising a plurality of pockets that enclose flexible material of sufficient density to substantially increase the weight of the article.

U.S. Pat. No. 4,407,497 is a weighted exercise suit designed to enable human users to exercise with added weights removably attached to a body suit. U.S. Pat. No. 5,810,699 is an exercise vest that includes lower and intermediate rows of pockets extending along the outside of its back and side sections into which weights may be placed. U.S. Pat. No. 5,951,446 is a weighted conditioning garment to help an individual lose weight and/or increase muscle strength and stamina that includes a plurality of weight members affixed to at least two elongated flexible members formed in the shaped of an article of clothing.

U.S. Pat. No. 5,553,322 is a weighted exercising garment formed of one piece of resilient flexible material so as to be a snug fit on the wearer's body. U.S. Pat. No. 6,557,176 is a weight vest including a shell constructed of a plurality of panels defining a front and a back. U.S. Pat. No. 5,144,694 is an exercise or physical therapy apparel including a vest, pants, spine strap, belt, wrist bands, ankle bands and weight packets. U.S. Pat. No. 6,675,391 is a weight vest comprising a front portion and a back portion having pockets into which a plurality of weights having a cylindrical shape may be placed.

Further, various inventions have been made to help swimmers train or compete. U.S. Pat. No. 3,142,485 is an external device that can potentially get in the way of the swimmers motion. This device does not allow for freedom of movement, and thereby does not allow the swimmer to swim naturally or to complete flip turns. U.S. patent application Ser. No. 10/755,606 is a design that does not allow for continued resistance. U.S. Pat. No. 5,002,268 is a device that may get in the way of a swimmer's normal swimming motion and is not good for all strokes or for completing the flip turns. U.S. Pat. No. 5,011,137 is a device that could get caught between the swimmer's legs during breast stroke, in turn making it less universal. U.S. Pat. No. 5,033,116 is a device that reduces fluid resistance. U.S. Pat. No. 6,546,560 helps a wearer swim faster by reducing resistance and it does not add resistance and it is not for training. U.S. Pat. No. 7,104,932 is a device that cannot be worn by multiple swimmers in the same lane and does not allow the swimmer to achieve the same feel of normal swimming.

Although these prior art inventions may have some utility, they can be too restrictive and uncomfortable, do not advantageously circulate and re-distribute heat, and do not provide for a variety of workout techniques. For example, prior art garments may have short sleeves to dissipate heat, but do not allow for a shoulder workout or are too bulky to wear under football shoulder pads or other sports-related pads and uniforms. For another example, other prior art garments target isolated muscle groups for additional resistance, such as the shoulders, but do not provide additional weights to the arms and the legs. Additionally, prior art devices utilizing weighted elements, such as wrist and thigh weights, are not integrated into a garment and may impede the motion of the wrists, arms, and legs, thus restricting the movement of the athlete. Further, the prior art may comprise thick and bulky material that does not allow for breathing which can make a wearer overly hot and which is uncomfortable to wear while exercising. On the aesthetic side, the prior art designs may not be fashionable, and may utilize adjustment straps, which are difficult and time-consuming to fasten, and are likewise not fashionable.

Further, to the swimmer, carrying extra weight may not be desirable or advantageous, as there is a risk of drowning should the swimmer be overburdened by the weight. As such, there is a need for an article of clothing that can be worn on the torso, such as a shirt, top, or singlet, that increases the muscle burden on a swimmer during training yet does not overly interfere with the movement of the wearer.

Notwithstanding the prior art, there is a need for an integrated article of weighted clothing that can be worn on the torso, such as a shirt or pant, that is fashionable, flexible, breathable, and weighted, yet does not interfere with other articles of clothing or the movement of the wearer. Also, voluminous fabrics are key to inducing drag on a swimmer without obstructing their stroke. The voluminous fabric works by affecting the fluid flow across the swimmers body. This is done through the concept of turbulent flow and affecting the boundary layer conditions of a swimmer. There also is a need for an article of weighted clothing that can be worn clandestinely underneath an outer garment without negatively affecting the aesthetics of the outer garment. There is also a need for drag inducing swimwear for wearing during an exercise regimen. It is to these needs and others that the present invention is directed.

BRIEF SUMMARY OF THE INVENTION

Briefly, in one exemplary embodiment, the present invention is weighted clothing having a plurality of relatively small weights strategically attached to the substrate clothing such that the weighted clothing is comfortable to wear, does not interfere to any great extent with outer clothing or equipment such as pads, and does not interfere with the wearer's movement, yet provides sufficient extra weight, cooling and/or heating properties, and corresponding resistance so as to increase the strength and stamina of the wearer's muscles upon continued use of the weighted clothing.

The substrate clothing can be made of natural or synthetic materials, such as but not limited to cotton, nylon, polyester, LYCRA, SPANDEX, and combinations and blends. Use of a relatively thin breathable or wicking material such as nylon can add to the comfort of the wearer. Preferably, the material of manufacture of the substrate clothing is a lightweight, soft, breathable, comfortable material that can be elastic or contains elastic.

The weights can be made of a plurality of gel packets or solidified gel forms that can be sewn or otherwise adhered in known manners to the substrate clothing in strategic areas. The weights can also be enclosed in a two-layered material pocket formed in the substrate clothing that may also allow for removable weights. The use of a gel helps dissipate heat from the athlete keeping the athlete cooler and more comfortable, and helping prevent heat exhaustion and stroke. A relatively dense gel also can provide a greater weight per volume while also integrating structural support and cooling ability into the clothing. The weights can be interconnected to each other so as to eliminate the need for attachment straps. Corrugated rubber weights may also be used for increased ventilation near the skin for increased comfort and flexibility.

The present invention also is a fashionable piece that can be worn under shoulder pads, padded pants, or any other apparatus, comfortably while providing extra weight and resistance for exercising the wearer's muscles and keeping the athlete cool. The gel can also be heated for therapeutic purposes.

The present invention also can apply weight resistance with external support thereby taking strain off of the joints, which is an improvement over the known prior art wrist and ankle weights. Whereas wrist and ankle weights apply centrifugal forces to the wearer's joints, the weighted clothing of the present invention absorbs the centrifugal forces of the weights, thereby taking strain off of the joints. As such, the present invention can be a health solution to the exercise dilemma of adding weight versus straining joints.

The substrate clothing can have the general shape of a common tee-shirt for the upper torso or a common athletic short for the lower torso. Preferably, the substrate clothing is a long-sleeved shirt such that weights can be strategically placed proximal to any portion of the wearer's upper torso. Similarly, preferably, the substrate clothing is an athletic pant that extends at least partway down the wearer's thighs such that weights can be strategically placed proximal to any portion of the wearer's lower torso and upper legs. Long pants also are contemplated to provide weights strategically proximal to the wearer's entire leg. Removable arm sleeves can also be integrated into the shirt with proper attachment methods. This exemplary embodiment of the invention can also be produced in a sports bra, as a weighted system or a cooling sports bra for runners, or as purely cooling apparel. The invention can also be produced in a lighter weight version and used for a cooling system for animals, such as dogs, during hot days. The present invention can also be produced in multiples of ways, such as but not limited to weighted jackets, weighted sleeves, weighted vests for comfort, flexibility, ease of use therapy, and thermal properties.

In one illustrative embodiment of the present invention, the weighted garment is worn underneath athletic uniforms and equipment, such as football pads, during practice sessions to increase resistance applied to a wearer's muscles and maximize the efficiency of a workout. As such, this embodiment of the invention preferably is relatively thin so as to not interfere with the function of the pads and the movement of the wearer. In another illustrative embodiment of the present invention, the weighted garment is worn under common exercise or weightlifting clothing. As such, this embodiment of the invention also preferably is relatively thin so as not to interfere with the exercise motion or the aesthetics of the common exercise clothing. In yet another illustrative embodiment of the invention, the weighted garment itself is worn as the exercise clothing. As such, this embodiment preferably presents pleasing aesthetic qualities as well as the stated functionality.

In another exemplary embodiment, the present invention is an exercise and training device for swimmers in the form of an article of clothing, such as a shirt, top, or singlet that, due to the material of manufacture, increases the resistance to the swimmer's movement through the water and thus helps at least in increasing lung capacity due to the additional effort needed by the swimmers and in the development of the swimming muscles. The substrate clothing can be made of natural or synthetic materials, such as but not limited to cotton, linen, wool, polyester, NYLON, LYCRA, SPANDEX, and combinations and blends. Use of a relatively thin material can add to the comfort of the wearer and can reduce interference with the wearer's natural swimming motion. Preferably, the material of manufacture of the substrate clothing is a lightweight, soft, comfortable material that is generally form-fitting to the wearer's body, and that can be elastic or contain elastic for this purpose. The fabric will induce turbulent flow thereby affecting the boundary layer of the fluid flow around the swimmers body. In doing this, the swimmer will feel the resistance effects of the fabric without the obstruction of their stroke.

The substrate clothing can have the general shape of a common long-sleeved tee-shirt or singlet. Preferably, the substrate clothing is a long-sleeved shirt that has thumb slits, loops or the equivalent on the hand end of the sleeve for looping over at least one finger so as to prevent the sleeve from riding or traveling up the arm during use. Alternatively, the substrate clothing is a long-sleeved singlet that (combined top and bottom) can be worn over or in place of a normal swimming suit that also has thumb slits, loops or the equivalent on the hand end of the sleeve for looping over at least one finger so as to prevent the sleeve from riding or traveling up the arm during use.

Other aspects and features of embodiments of the present invention will become apparent to those of ordinary skill in the art, upon reviewing the following detailed description in conjunction with the accompanying figures.

BRIEF DESCRIPTION OF THE FIGURES

The various embodiments of the invention can be better understood with reference to the following drawings. The components in the drawings are not necessarily to scale, emphasis instead being placed upon clearly illustrating the principles of the various embodiments of the present invention. In the drawings, like reference numerals designate corresponding parts throughout the several views.

DETAILED DESCRIPTION OF PREFERRED EMBODIMENTS

Figure 1:
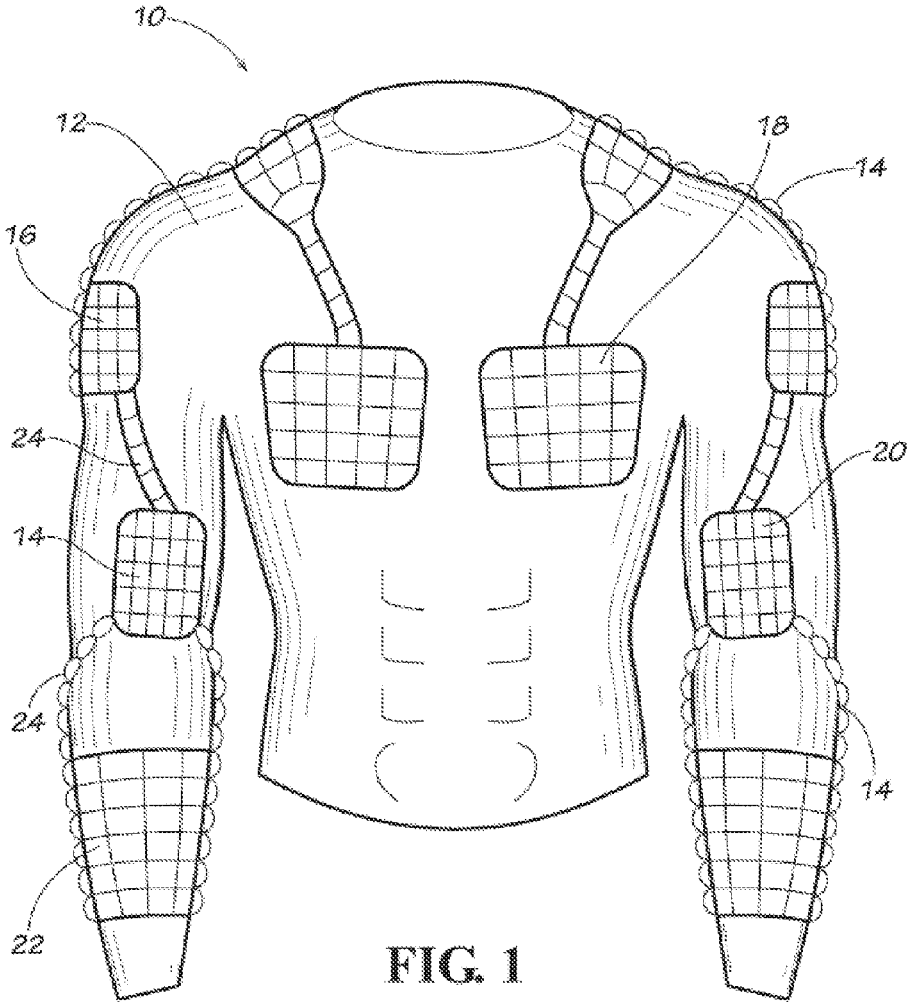
FIG. 1 is a perspective view of the front of a first embodiment of the invention showing an upper-torso covering garment.

Although preferred embodiments of the invention are explained in detail, it is to be understood that other embodiments are contemplated. Accordingly, it is not intended that the invention is limited in its scope to the details of construction and arrangement of components set forth in the following description or illustrated in the drawings. The invention is capable of other embodiments and of being practiced or carried out in various ways. Also, in describing the preferred embodiments, specific terminology will be resorted to for the sake of clarity.

It must also be noted that, as used in the specification and the appended claims, the singular forms "a," "an" and "the" include plural referents unless the context clearly dictates otherwise.

Also, in describing the preferred embodiments, terminology will be resorted to for the sake of clarity. It is intended that each term contemplates its broadest meaning as understood by those skilled in the art and includes all technical equivalents which operate in a similar manner to accomplish a similar purpose.

Ranges may be expressed herein as from "about" or "approximately" one particular value and/or to "about" or "approximately" another particular value. When such a range is expressed, another embodiment includes from the one particular value and/or to the other particular value.

By "comprising" or "containing" or "including" is meant that at least the named compound, element, particle, or method step is present in the composition or article or method, but does not exclude the presence of other compounds, materials, particles, method steps, even if the other such compounds, material, particles, method steps have the same function as what is named.

It is also to be understood that the mention of one or more method steps does not preclude the presence of additional method steps or intervening method steps between those steps expressly identified. Similarly, it is also to be understood that the mention of one or more components in a device or system does not preclude the presence of additional components or intervening components between those components expressly identified.

Weighted Exercise Clothing

Figure 2:
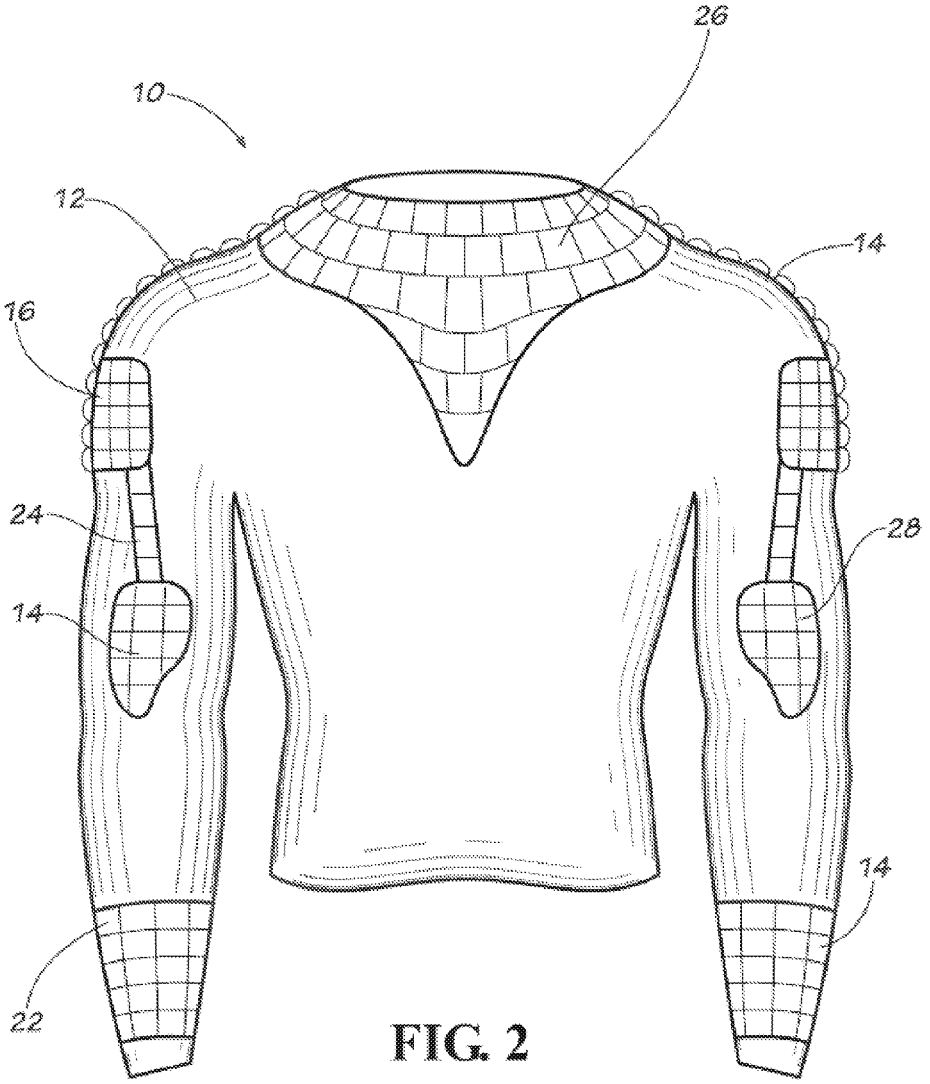
FIG. 2 is a perspective view of the back of a first embodiment of the invention showing an upper-torso covering garment.
Figure 3:
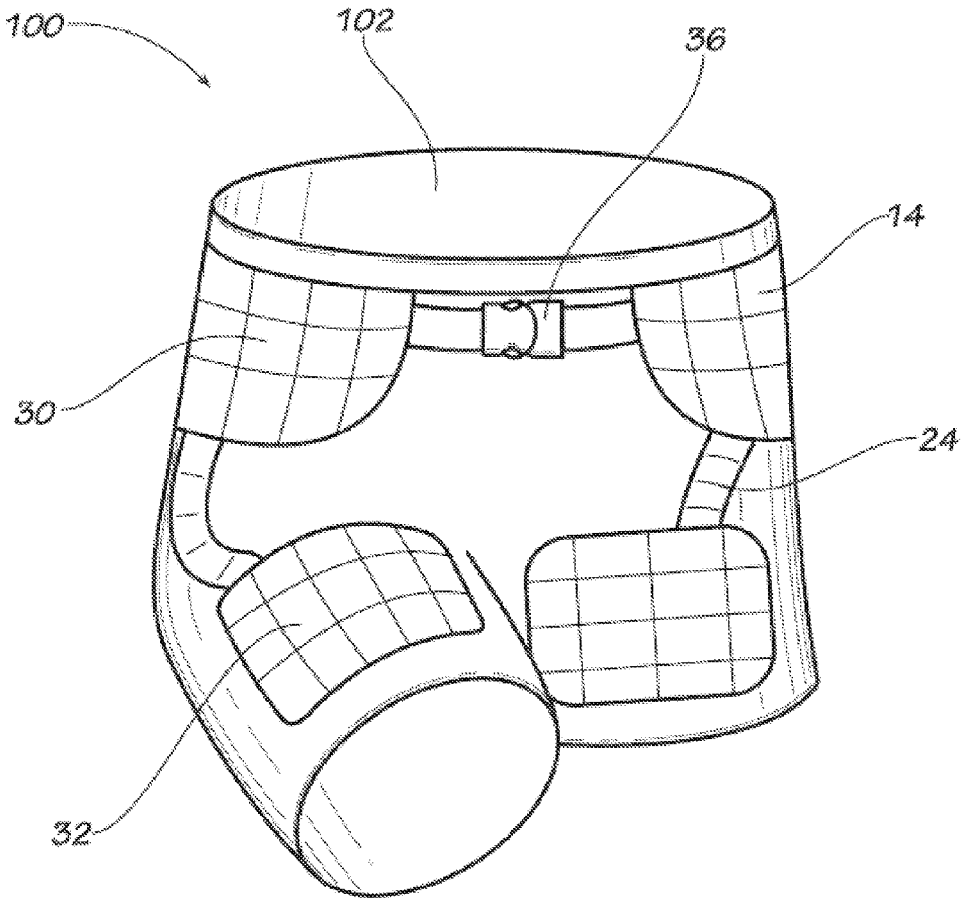
FIG. 3 is a perspective view of the front of a second embodiment of the invention showing a lower-torso covering garment.
Figure 4:
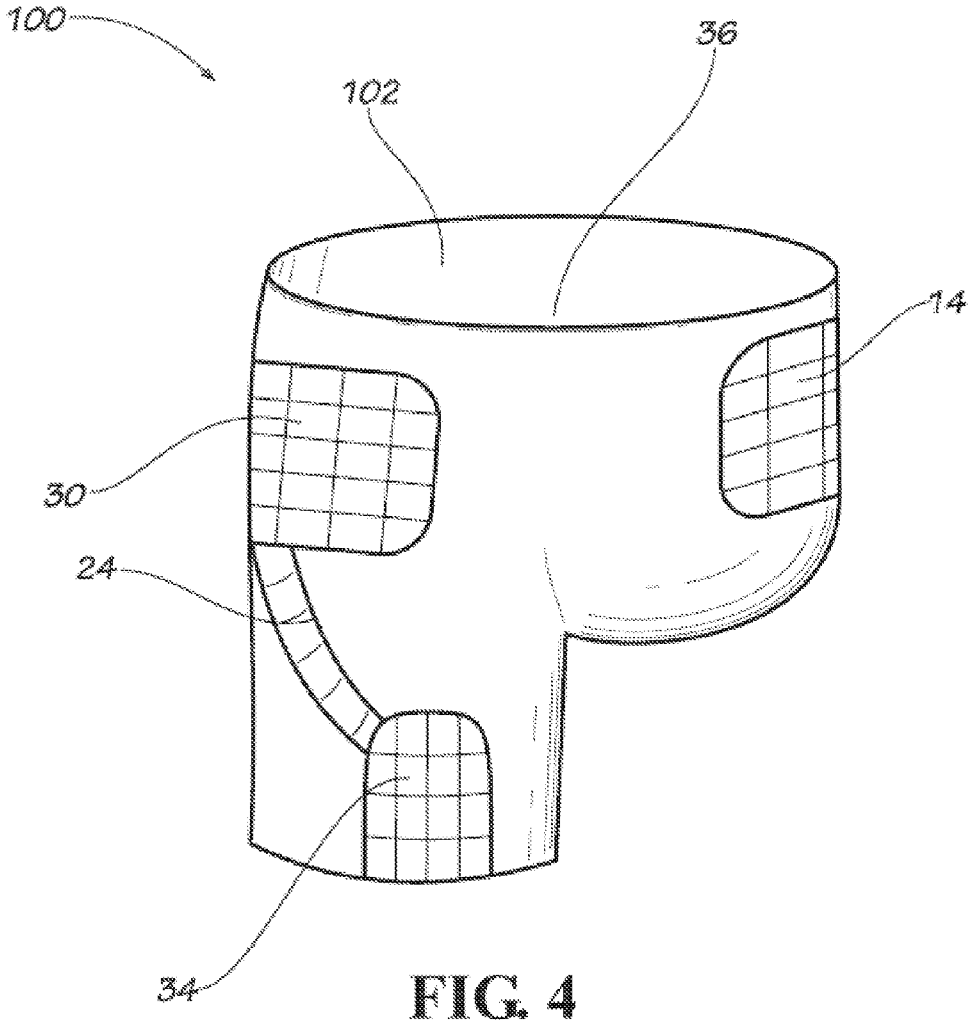
FIG. 4 is a perspective view of the back of a second embodiment of the invention showing a lower-torso covering garment.
Figure 5:
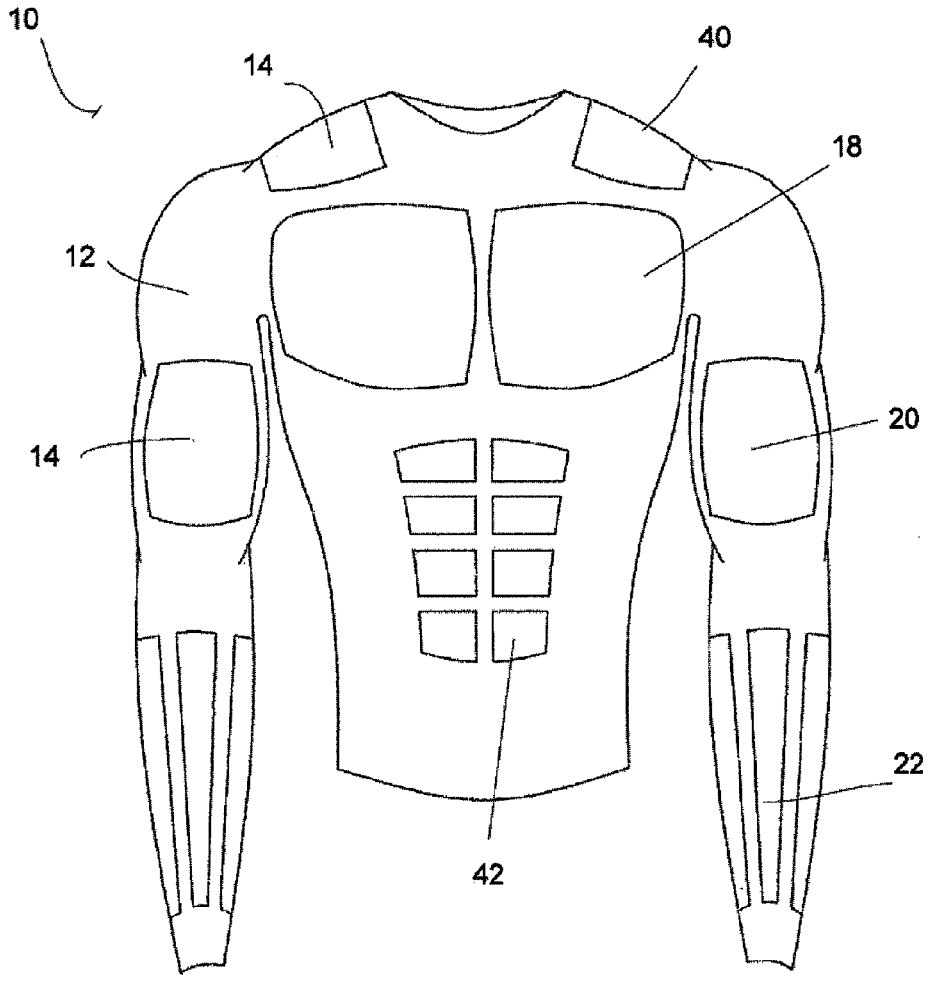
FIG. 5 is a perspective view of the front of a third embodiment of the invention showing an upper-torso covering garment and further detailing illustrative shape and placement of weighted pads.
Figure 6:
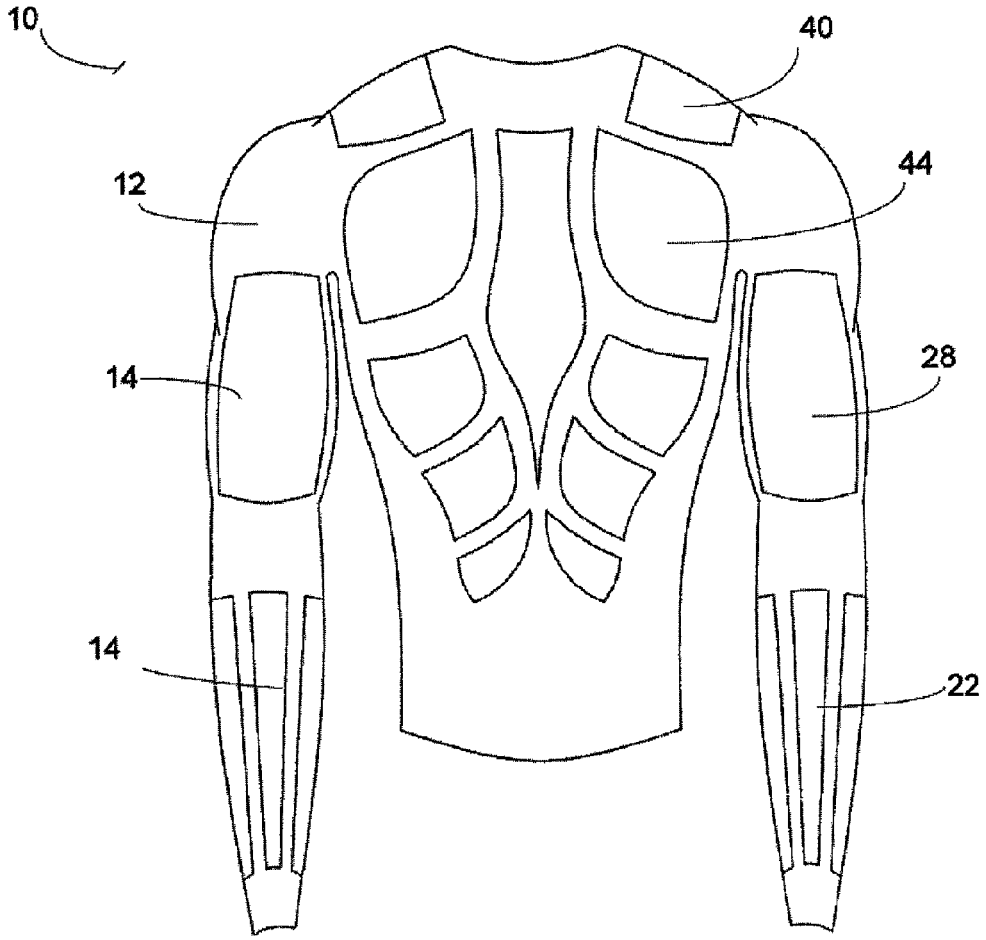
FIG. 6 is a perspective view of the back of a third embodiment of the invention showing an upper-torso covering garment and further detailing illustrative shape and placement of weighted pads.
Figure 10B:
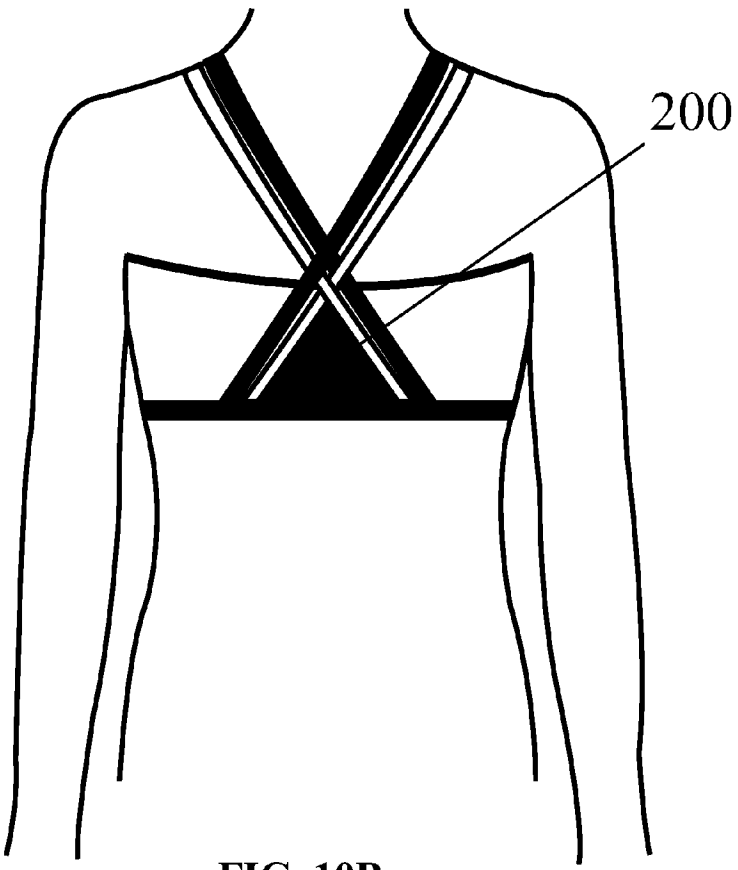
FIGS. 10A-10B are front and back views, respectively, of a sports bra embodiment of the invention.
Figure 10A:
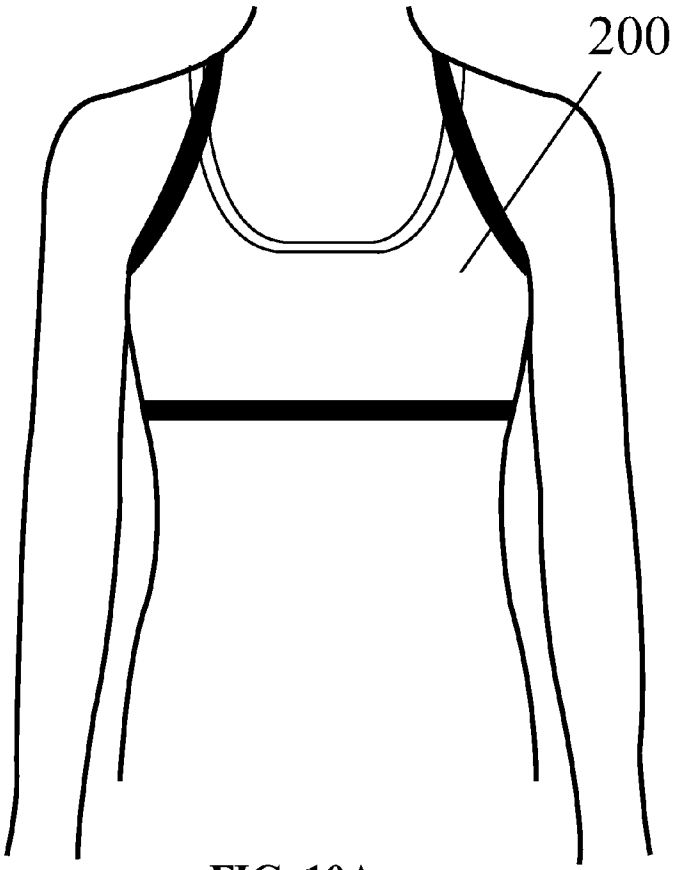

Illustrative embodiments of a weighted garment for providing additional resistance to the muscles of a wearer and maximizing the effects and efficiency of a workout are shown in FIGS. 1 through 6. FIG. 1 is a perspective view of the front of a first embodiment of the invention, namely a shirt, showing an illustrative placement of the weights on the front of the shirt. FIG. 2 is a perspective view of the back of the first embodiment of the invention also showing an illustrative placement of the weights on the back of the shirt. FIG. 3 is a perspective view of the front of a second embodiment of the invention, namely pants, showing an illustrative placement of the weights on the front of the pants. FIG. 4 is a perspective view of the back of the second embodiment of the invention also showing an illustrative placement of the weights on the back of the pants. FIG. 5 is a perspective view of the front of a third embodiment of the invention showing another illustrative placement and shape of the weights on the front of the shirt. FIG. 6 is a perspective view of the back of a third embodiment of the invention showing another illustrative placement and shape of the weights on the back of the shirt. FIGS. 10A-10B are front and back views, respectively, of a sports bra 200 embodiment of the invention.

The present invention is weighted clothing having multiple small weights with strategic shape and placement on substrate clothing. The present invention applies additional resistance to corresponding muscles, maximizing the effect and efficiency of a user's workout. The garment is low-profile, sleek and streamlined so as not to be overly bulky or to obstruct a user's movements and yet to remain aesthetically pleasing. The present invention is suitable for use in conjunction with cardiovascular exercise, weightlifting, calisthenics, yoga, sports training, physical therapy, and other physical activities. Currently, there is a need for weighted exercise garments that are comfortable, breathable, easy to use, stylish, and do not interfere with other garments or the physical movements of a user.

Referring now to the figures, the present invention is weighted clothing 10, 100 having a plurality of relatively small weights 14 strategically attached to the substrate clothing 12, 102 such that the weighted clothing 10, 100 is comfortable to wear and stylish, does not interfere to any great extent with outer clothing or equipment such as protective football pads, and does not interfere with the wearer's movement, yet provides sufficient extra weight and resistance so as to increase the strength and stamina of the wearer's muscles upon continued use of the weighted clothing 10, 100.

FIG. 1 is a perspective view of the front of a first embodiment of the invention, namely a weighted shirt 10, showing an illustrative placement and shape of the weights 14 on the front of the weighted shirt 10. The illustrative substrate shirt 12 has the shape of a common long-sleeved tee-shirt or fitted athletic shirt. Weights 14 can be strategically placed on the substrate shirt 12 such that the weights 14 are proximal to any portion of the wearer's upper torso. In the illustrative embodiment shown in FIG. 1, the weights 14 are shown attached to the front of the substrate shirt 12 as a shoulder weight cluster 16, a pectoral weight cluster 18, a bicep weight cluster 20, and a forearm weight cluster 22. The placement of the weights 14 thus corresponds to an underlying muscle group. Linking strands 24 of weights can connect the various weight clusters 16, 18, 20, 22 so as to maintain the weight clusters 16, 18, 20, 22 in place without the need for additional attachment straps. Linking strands 24 also help distribute the weight of the weight clusters 16, 18, 20, 22 to maintain the integrity and longevity of the garment and to effectuate a full-body workout. Additional weight clusters can be attached to the substrate shirt 12 as necessary or desired, especially to connect with target muscle groups or to accommodate the anatomy, needs, and sex of a wearer.

Referring now to FIG. 2, a perspective view of the back of the first embodiment of the invention shows illustrative placement of the weights 14 on the back of the shirt 10. In the illustrative embodiment shown in FIG. 2, the weights 14 are shown attached to the substrate shirt 12 as a neck weight cluster 26, a shoulder weight cluster 16, a triceps weight cluster 28, and a forearm weight cluster 22. A linking strand 24 is not necessary between the triceps weight cluster 28 and the forearm weight cluster 22 on the back of the shirt 10 due to the presence of a linking strand 24 between the bicep weigh cluster 20 and the forearm weight cluster 22 on the front of the shirt 10. Additional and interchangeable linking strands 24, however, may be strategically placed to achieve a desired distributive effect on target muscle groups.

The specific illustrative embodiment shown in FIGS. 1 and 2 is optimized for wearing under athletic equipment such as football shoulder pads or lacrosse or hockey protective gear. Specifically, the weight clusters 16, 18, 20, 22, 26, 28 are placed on the substrate shirt 12 so as not to interfere with the placement of the protective gear on the wearer. Even more specifically, the weight clusters 16, 18, 20, 22, 26, 28 are placed on the substrate shirt 12 in areas that football shoulder pads do not place a significant amount of pressure. Various other illustrative shirt embodiments of the invention 10 can be designed by those of ordinary skill in the art for use in connection with other types of pads, with various uniforms, and with no pads or uniforms. In general, in embodiments of the invention such as represented by FIGS. 1 and 2, the weight clusters 16, 18, 20, 22, 26, 28 are strategically placed so as not to interfere with the joints, thus allowing a greater freedom of motion.

FIG. 3 is a perspective view of the front of a second embodiment of the invention, namely weighted pants 100, showing an illustrative placement of the weights 14 on the front of the weighted pants 100. The illustrative substrate pants 102 are a fitted short or athletic pant that extends at least partway down the wearer's thighs such that weights 14 can be strategically placed proximal to any portion of the wearer's lower torso and upper legs. Long pants (not shown) also are contemplated to provide weights 14 strategically proximal to the wearer's entire leg. In the illustrative embodiment shown in FIG. 3, the weights 14 are shown attached to the front of the substrate pants 102 as a hip weight cluster 30 and a thigh weight cluster 32. Linking strands 24 of weights can connect the various weight clusters 30, 32 so as to maintain the weight clusters 30, 32 in place and to effectuate a full-body workout without the need for additional attachment straps. Additional weight clusters can be attached to the substrate pants 102 as necessary or desired, depending on the preferred amount and placement of resistance, especially to connect with target muscle groups or to accommodate the anatomy, needs, and sex of a wearer. A belt 36 can be fed underneath the weight cluster in a typical material channel in a known manner to provide additional support.

FIG. 4 is a perspective view of the back of the second embodiment of the invention also showing an illustrative placement of the weights 14 on the back of the pants 100. In the illustrative embodiment shown in FIG. 4, the weights 14 are shown attached to the substrate pants 102 as a hip weight cluster 30 and a hamstring weight cluster 34.

The specific illustrative embodiment shown in FIGS. 3 and 4 is optimized for wearing under padded football pants. Specifically, the weight clusters 30, 32, 34 are placed on the substrate pants 102 so as not to interfere with the placement of the football thigh pads on the wearer. Even more specifically, the weight clusters 30, 32, 34 are placed on the substrate pants 102 in areas that the football thigh pads do not place a significant amount of pressure. Various other illustrative pants embodiments of the invention 100 can be designed by those of ordinary skill in the art for use in connection with other types of pads, with various uniforms, and with no pads or uniforms. In general, in embodiments of the invention, such as those represented by FIGS. 3 and 4, the weight clusters 30, 32, 34 are strategically placed so as not to interfere with the joints, thus allowing a greater freedom of motion.

FIG. 5 is a perspective view of the front of a third embodiment of the invention, namely a weighted shirt 10, showing an alternative illustrative placement and shape of the weights 14 on the front of the weighted shirt 10. The illustrative substrate shirt 12 also has the shape of a common long-sleeved fitted athletic shirt, similar to that shown in FIGS. 1 and 2. Weights 14 are adhered, sewn, or attached by known means in strategic locations on the substrate shirt 12 such that the weights 14 are proximal to any portion of the wearer's upper torso. In the illustrative embodiment shown in FIG. 5, the weights 14 are shown attached to the front of the substrate shirt 12 as a trapezius weight cluster 40, a pectoral weight cluster 18, a bicep weight cluster 20, a forearm weight cluster 22, and an abdominal weight cluster 42. The placement of the weights 14 thus corresponds to an underlying muscle group. Linking strands 24 are not needed, as in the first and second illustrative embodiments, in part because of the lower profile yet higher density of the weights 14 within the fitted substrate shirt 12, and the high surface area coverage of the shape of the weights 14 in this illustrative embodiment which helps to maintain the integrity and longevity of the garment.

Referring now to FIG. 6, a perspective view of the back of the third embodiment of the invention shows illustrative placement of the weights 14 on the back of the shirt 10. In the illustrative embodiment shown in FIG. 6, the weights 14 are shown attached to the substrate shirt 12 as a back weight cluster 44, a trapezius weight cluster 40, a triceps weight cluster 28, and a forearm weight cluster 22. Additional weights 14 may be strategically placed to achieve desired resistance to target muscle groups.

The specific illustrative embodiments shown in FIGS. 5 and 6 are also optimized for wearing under athletic equipment such as football shoulder pads or lacrosse or hockey protective gear. In addition, due to their anatomically correct placement, and the shape and profile of the weight clusters 18, 20, 22, 28, 40, 42, 44, the weights 14 do not interfere with the physical motion of a wearer. The spaces between the weight clusters 18, 20, 22, 28, 40, 42, 44 allow for natural flexibility and movement of the substrate shirt 12 unimpeded by any added mass or thickness. Further, the weight clusters 18, 20, 22, 28, 40, 42, 44 do not place undue pressure on a wearer when used in conjunction with athletic gear or when performing exercises that involve technical movements or flexibility, like yoga or weightlifting. Further, this illustrative embodiment is not bulky so as to inhibit a user from wearing the garment underneath other athletic clothing. In fact, the anatomical placement and shape of the weights 14 is aesthetically pleasing and may enhance the look of wearer either when the garment is worn alone or underneath another garment.

The substrate clothing 12, 102 can be made of natural or synthetic materials, such as but not limited to cotton, nylon, polyester, LYCRA, SPANDEX, and combinations and blends. Use of a relatively thin breathable or wicking material such as nylon can add to the comfort of the wearer. Preferably, the material of manufacture of the substrate clothing 12, 102 is a lightweight, soft, comfortable material that can be elastic or contains elastic such that the material is form-fitting.

The weights 14 can be made of a plurality of gel packets or solidified gel forms, both of which are referred to herein as gel packets 14A, that can be sewn, attached with adhesives, attached by melting, or otherwise adhered to the substrate clothing 12, 102 in strategic areas. In one embodiment, various smaller gel packets 14A, shown as squares in the figures, are attached together to form the various weight clusters 16, 18, 20, 22, 26, 28, 30, 32, 34 and the linking strands 24. In another embodiment, a larger gel packet 14A having the general shape of each of the weight clusters 16, 18, 20, 22, 26, 28, 30, 32, 34 and the linking strands 24 can be formed or scored to have thinner areas 14B for flexibility. In another embodiment, the gel packets 14A are placed within an outer covering or pocket for containing the gel packets 14A. Although it is preferable that the weights 14, and therefore the gel packets 14A, be as thin as possible to prevent interference with other clothing and with the wearer's actions, the weights 14 can be made thicker or thinner depending on the density of the gel and the weight desired.

Suitable gels are known in the art and preferably are non-toxic, non-staining, and hypoallergenic. Solid gels are preferred to prevent leaking and loss of gel; however, liquid gels can be used if contained in a suitable containment outer layer. The use of a gel can dissipate heat from the athlete keeping the athlete cooler and more comfortable, and helping prevent heat exhaustion and stroke. Further, a gel can also serve as a shock absorber to protect a wearer from impact injury, such as might occur in football, hockey, and any number of sports. A relatively dense gel also can provide a greater weight per volume while also integrating structural support and cooling ability into the clothing 10, 100. The weights 14 can be interconnected to each other so as to eliminate the need for attachment straps.

One embodiment of the present invention is to wear underneath athletic uniforms and equipment, such as football pads, during practice sessions. As such, this embodiment of the invention preferably is relatively thin so as to not interfere with the function of the pads. Another embodiment of the invention is to wear under common exercise clothing. As such, this embodiment of the invention also preferably is relatively thin so as not to interfere with the exercise motion or the aesthetics of the common exercise clothing. Another embodiment of the invention is to wear as the exercise clothing. As such, this embodiment preferably is made aesthetically pleasing in and of itself. The present invention also is a fashionable piece that can be worn under shoulder pads, padded pants, or any other apparatus, comfortably while providing the extra weight for exercising the wearer's muscles, keeping the athlete cool, and providing a distributive effect to redirect forces upon muscles and muscle groups.

The wearing of the weighted clothing 10, 100 is determined by its structure. Because of the described features of the weighted clothing 10, 100 a wearer can easily and quickly put on the clothing in a manner similar to putting on a common tee-shirt or athletic pants. It is understood by persons of ordinary skill in the art that the optimal dimensions, sizes, and materials for the invention depend on the size of the wearer, manufacturing materials, and aesthetics or design of the outer garment, just like any other piece of clothing. Such parameters for the present invention can be determined without undue experimentation.

Drag Inducing Swimwear

Figure 8:
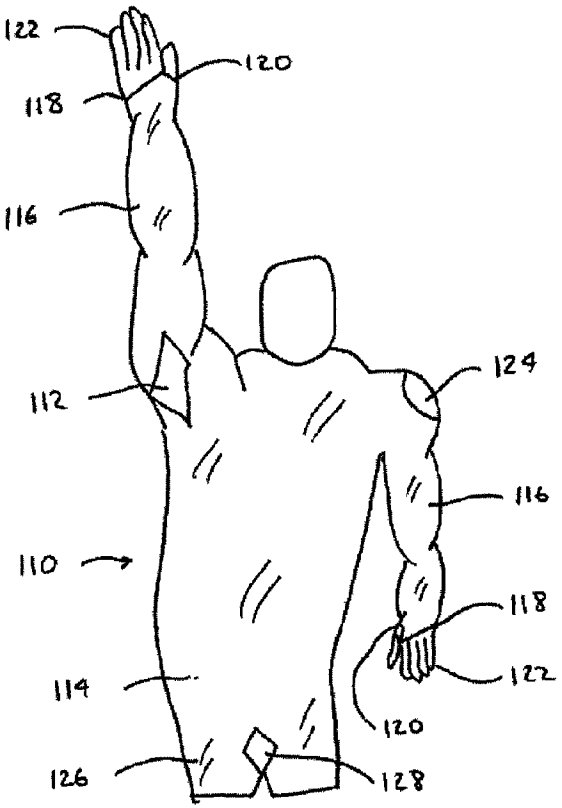
FIG. 8 is a front view of a second swimwear embodiment of the invention.
Figure 7:
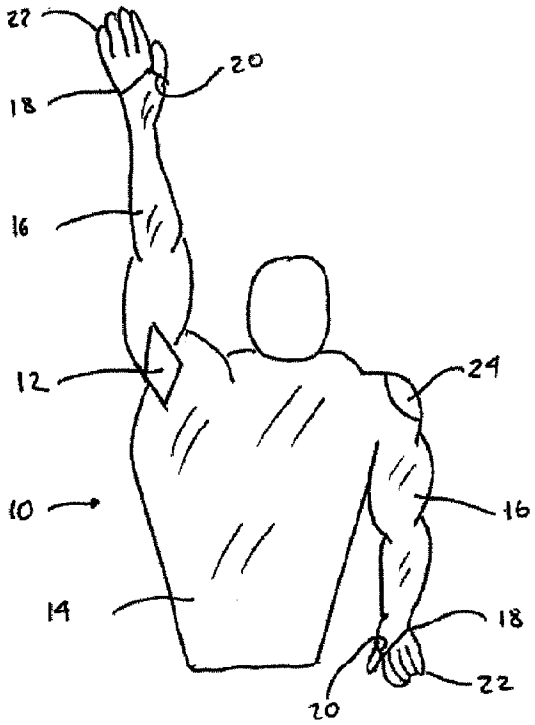
FIG. 7 is a front view of a swimwear embodiment of the invention.
Figure 9B:
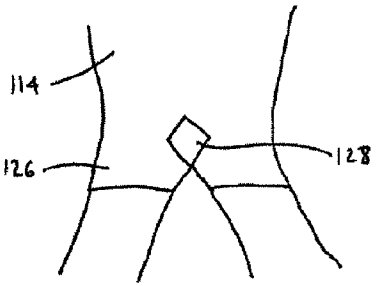
FIGS. 9A-9D are front views of swimwear embodiments, with FIG. 9A showing a bikini design, FIG. 9B showing a short leg design, FIG. 9C showing a mid leg design, and FIG. 9D showing a long leg design.
Figure 9A:
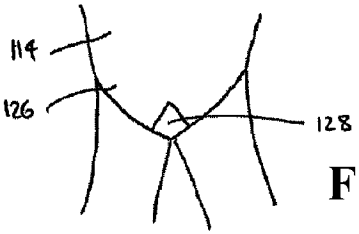
Figure 9D:
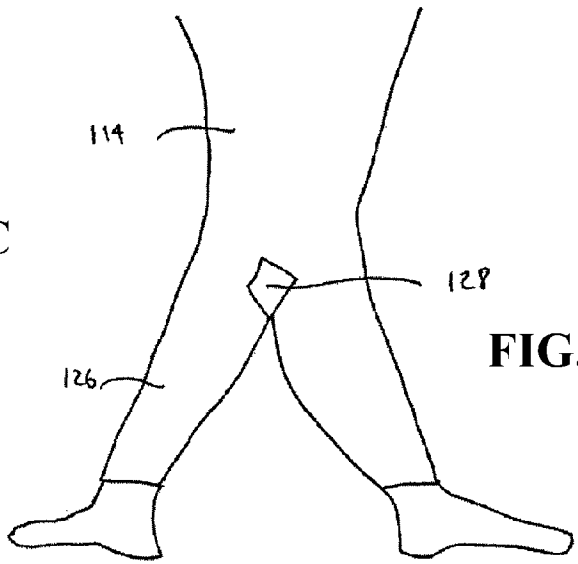
Figure 9C:
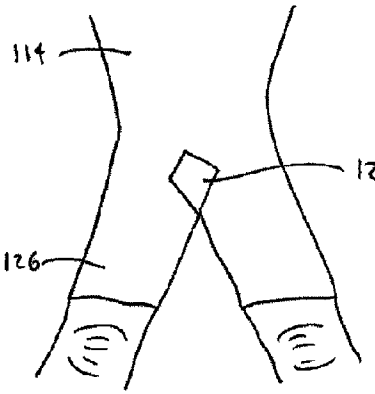

FIG. 7 is a front view of a first embodiment of the invention illustrating a long-sleeved top. FIG. 8 is a front view of a second embodiment of the invention illustrating a long-sleeved singlet. Both of these illustrative embodiments comprise thumb slits or finger loops for preventing the sleeve from riding or traveling up the arm during use. FIGS. 9A-9D are front views of illustrative the pant portions of the invention, with FIG. 9A showing a bikini design, FIG. 9B showing a short leg design, FIG. 9C showing a mid leg design, and FIG. 9D showing a long leg design.

Referring now to FIG. 7, a first illustrative embodiment of the invention is shown. Preferably, this embodiment of the invention is a tight fit cotton-based stretch fabric top 10. As can be seen, the top 10 comprises a body 14 and sleeves 16 in a torso-fitting configuration. The hand end 18 of the sleeves 16 comprise a loop or thumb slit 20 for fitting over at least one of the wearer's fingers 22 for preventing the sleeves 16 from riding or traveling up the wearer's arms during use. The armpit 12 region of the top 10 can be the same material as, or a different material than, the rest of the top 10. Preferably, the armpit 12 region is an extremely elastic fabric for the so as to not hinder the swimmer's movement. Such an armpit 12 region material can be manufactured into the top 10 in conventional known manners. Additionally, other extremely elastic regions can be included, such as on the top of the shoulder 24 for a similar purpose.

Referring now to FIG. 8, a second illustrative embodiment of the invention is shown. Preferably, this embodiment of the invention is a tight fit cotton-based stretch fabric singlet 110. As can be seen, the singlet 110 also comprises a body 114 and sleeves 116 in a torso-fitting configuration, but also comprises a pant 126 portion. As shown in FIGS. 3A-3D, the pant 126 portion can be structured in a bikini design (FIG. 9A), a short leg design (FIG. 9B), a mid leg design (FIG. 9C), a long leg design (FIG. 9D), or other designs. The pant 126 portion preferably is made from the same material as the body 114 and sleeves. The hand end 118 of the sleeves 116 comprise a loop or thumb slit 120 for fitting over at least one of the wearer's fingers 122 for preventing the sleeves 116 from riding or traveling up the wearer's arms during use. The armpit 112 region of the singlet 110 can be the same material as, or a different material than, the rest of the singlet 110. Preferably, the armpit 112 region is an extremely elastic fabric for the so as to not hinder the swimmer's movement. Such an armpit 112 region material can be manufactured into the singlet 110 in conventional known manners. Additionally, other extremely elastic regions can be included, such as on the top of the shoulder 124 or the crotch 128 for a similar purpose.

The preferred cotton-based stretch fabric is selected to exert enough drag resistance to the water for the swimmer without getting in the path of the hands or other movements of the swimmer. Such drag resistance coupled with non-interference to the swimmer's motion is an important aspect of the design. The preferred fabrics exert a drag resistance to the water even in flip turns, but do not interfere with the flip turns, unlike known prior art. This also is an important aspect of the design, as because races often are won and lost on flip turns, it is important that the swimmer is able to practice flip turns without any undue interference. The preferred fabric can be either single or double layered.

In use, the drag coefficient of the material of manufacture of the swimwear 10, 110 is larger than the drag coefficient of, for example, typical swimwear or racing swimwear, or the wearer's skin. The wearer puts on the swimwear 10, 110 in a manner similar to putting on a common top or singlet, and engages in a desired regimen. The extra drag created by the swimwear 10, 110 relative to the water increases the muscle exertion by the wearer, thus both giving the wearer a workout with greater exertion and potentially increasing the muscle mass and stamina, as well as potentially increasing lung capacity and the development of the swimming muscles due to the additional effort needed by the swimmers. The preferred elastic and close-fitting design of the swimwear does not interfere unduly with the wearer's natural swimming motions, including flip turns. The preferred extremely elastic armpit 12 and crotch 128 regions (and other regions, if desired) adds to the wearer's ability to have a natural swimming stroke and complete flip turns, and adds to the comfort of the swimwear 10, 110.

A difference in the present invention relative to the prior art is that the present invention is a tight-fitting preferably elastic fabric that stays close to the wearer's body. Regular cotton and other natural materials stretch in the water, thereby getting in the way of the swimmer's stroke and also increasing the wearer's consciousness of the swimwear 10, 110. With increased wearer consciousness of the swimwear 10, 110, the wearer may subconsciously alter their stroke. Thus, the swimwear 10, 110 is designed so there will be very little movement with respect to the wearer's body. By decreasing the wearer's awareness of the swimwear 10, 110, the resistance training will have even more effect by allowing the wearer to concentrate on their form and not on the swimwear 10, 110.

The wearing of the swimwear 10, 110 is obvious from its structure. Because of the described features of the swimwear 10, 110, a wearer can easily and quickly put it on in a manner similar to putting on a common tee-shirt or singlet. It is understood by persons of ordinary skill in the art that the optimal dimensions and sizes for the invention depend on the size of the wearer, manufacturing materials, and aesthetics or design, just like any other piece of clothing. Such parameters for the present invention can be determined without undue experimentation. For example, preferably, the swimwear 10, 110 is made of a material, or thickness of material, that does not absorb or retain enough water to cause the wearer to sink.

Numerous characteristics and advantages have been set forth in the foregoing description, together with details of structure and function. While the invention has been disclosed in several forms, it will be apparent to those skilled in the art that many modifications, additions, and deletions, especially in matters of shape, size, and arrangement of parts, can be made therein without departing from the spirit and scope of the invention and its equivalents as set forth in the following claims. Therefore, other modifications or embodiments as may be suggested by the teachings herein are particularly reserved as they fall within the breadth and scope of the claims here appended.

What is claimed is:

1. An article of clothing, comprising:

a clothing substrate comprising a first pocket and a second pocket, wherein the first pocket and second pocket are strategically placed so as not to interfere with the movements of a wearer;

at least one weighted element housed in each of the first and second pockets; and at least one linking strand disposed between the first and second pockets, the at least one linking strand comprising a plurality of serially connected weighted elements, wherein the width of the at least one linking strand is less than the width of the at least one weighted element housed in each of the first and second pockets.

2. The article of clothing of claim 1, wherein the first pocket and the second pocket are strategically placed so as not to interfere with outer clothing or equipment worn over the article of clothing.

3. The article of clothing of claim 1, wherein at least a portion of the clothing substrate is breathable.

4. The article of clothing of claim 1, wherein at least one of the plurality of serially connected weighted elements comprises a gel.

5. The article of clothing of claim 1, wherein the at least one linking strand maintains the at least one weighted element in place with respect to the body of a person wearing the article of clothing when the person moves.

6. The article of clothing of claim 1, further comprising a support belt.

7. The article of clothing of claim 1, wherein the at least one weighted element is gel.

8. The article of clothing of claim 1, wherein the at least one linking strand is attached to the clothing substrate.

9. The article of clothing of claim 1, wherein the at least one weighted element is shaped to contact the clothing substrate with maximum surface area such that the at least one weighted element adheres naturally to the anatomy of a wearer.

10. An article of clothing, comprising:

a clothing substrate comprising a first pocket and a second pocket, wherein the first pocket and second pocket are strategically placed so as not to interfere with the movements of a wearer;

at least one weighted element housed in each of the first and second pockets; and wherein the first and second pockets are linked together via a linking strand, the linking strand comprising a plurality of serially connected weighting elements, wherein the width of the linking strand is less than the width of the at least one weighted element housed in each of the first and second pockets.

11. The article of clothing of claim 10, wherein the first pocket and the second pocket are strategically placed so as not to interfere with outer clothing or equipment worn over the article of clothing.

12. The article of clothing of claim 10, wherein at least a portion of the clothing substrate is breathable.

13. The article of clothing of claim 10, wherein at least one of the plurality of serially connected weighting elements comprises a gel.

14. The article of clothing of claim 10, wherein the linking strand maintains the at least one weighted element in place with respect to the body of a person wearing the article of clothing when the person moves.

15. The article of clothing of claim 10, further comprising a support belt.

16. The article of clothing of claim 10, wherein the at least one weighted element is shaped to contact the clothing substrate with maximum surface area such that the at least one weighted element adheres naturally to the anatomy of a wearer.

17. The article of clothing of claim 10, wherein the at least one weighted element is gel.

18. The article of clothing of claim 10, wherein the linking strand is attached to the clothing substrate.

19. An article of clothing, comprising:

a clothing substrate comprising:

a first pocket housing a first weighted gel element;

a second pocket housing a second weighted gel element; and wherein the first and second pockets are strategically placed adjacent to one or more of a wearer's corresponding muscles groups; and at least one linking strand disposed between the first and second pockets, the at least one linking strand comprising a plurality of serially connected weighted elements, wherein the width of the at least one linking strand is less than the width of each of the first and second weighted gel elements.

20. The article of clothing of claim 19, wherein the at least one linking strand is attached to the clothing substrate.

* * * * *